United States Patent [19]

Björklund

[11] 4,134,428

[45] Jan. 16, 1979

[54] NON-DRIP VALVE

[76] Inventor: Curt A. Björklund, Box 99, Stenasgatan 14, Ulricehamn, Sweden

[21] Appl. No.: 825,586

[22] Filed: Aug. 18, 1977

[30] Foreign Application Priority Data

Aug. 31, 1976 [SE] Sweden ..... 7609591

[51] Int. Cl.[2] ..... F16K 23/00

[52] U.S. Cl. ..... 137/882; 137/614.2; 137/877; 137/881; 222/108; 239/124

[58] Field of Search ..... 137/614.2, 877, 881, 137/882; 141/115, 116, 117; 222/108; 239/124

[56] References Cited

U.S. PATENT DOCUMENTS 2,741,301 4/1956 Lines ..... 222/108 X 3,886,974 6/1975 Bjorklund ..... 141/116 X

*Primary Examiner*—Martin P. Schwadron
*Assistant Examiner*—Gerald A. Michalsky
*Attorney, Agent, or Firm*—Dorfman, Herrell and Skillman

[57] ABSTRACT

In a non-drip valve for a fluid-flow line having a supply chamber, a discharge chamber and a vacuum chamber connected to the discharge chamber to withdraw fluid therefrom when the forward flow is arrested, pressure-responsive valve means controlling the forward flow from the supply chamber to the discharge chamber, and relief valve means to permit reverse flow bypassing said pressure-responsive valve when it is closed. Preferably a selectively-operable valve is provided to put said pressure-responsive valve in working condition.

10 Claims, 5 Drawing Figures

NON-DRIP VALVE

The present invention concerns a fluid valve and, more particularly, a non-drip valve for liquids which opens and closes when there is a predetermined level of pressure of the supply liquid and also limits post-drip when the valve closes.

The object of the invention is to further develop valves of the type shown in my U.S. Pat. No. 3,886,974, issued June 3, 1975, in different respects to further the advancement of technology.

More specifically, the invention provides an improved valve of this type which may be selectively activated to respond to the pressure of the supply liquid.

These objects are achieved according to the invention in that a valve of the type mentioned before is characterized substantially by means affording relief of accumulated pressure in the anti-drip control parts of the valve.

Further features and advantages of the invention are revealed from following detail-description with reference to the accompanying drawings. These show in detail:

Figure 1:
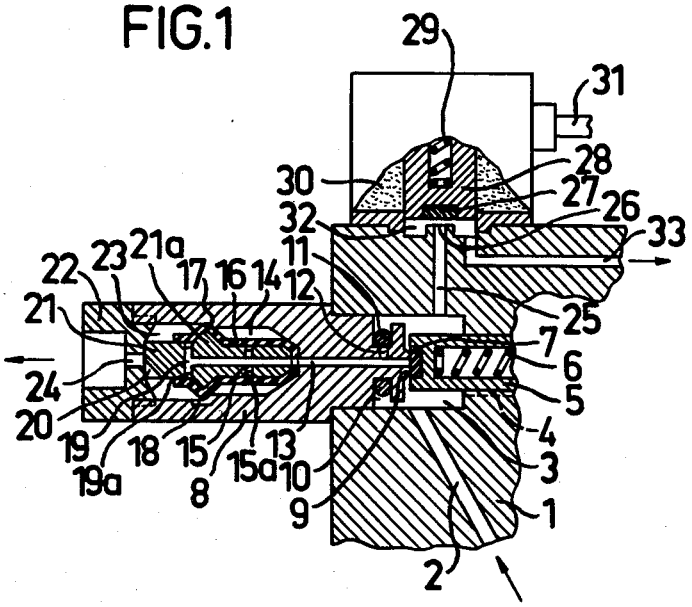
FIG. 1 illustrates a preferred embodiment of valve apparatus according to the invention with control unit according to the invention in cross-section and in position of rest.

The valve and the control unit according to the invention are preferably designed to be built into liquid pipelines, preferably the fuel oil supply line to a burner nozzle. Of course, even other technical uses are conceivable and the valve and the control unit according to the invention will certainly comprise even these. In FIG. 1, 1 designates a casing containing an inlet 2, leading to a supply chamber 3, from which a pressure regulating channel 4 extends, which may communicate with the return line to a pump (not shown). A pressure piston 5 extends into the chamber 3. This piston contains preferably a helical pressure spring 6 and is provided with a seal disc 7, fixed in its free end surface, which disc is designed in its rest position to bear against a seat 9 that is formed at an end of a connection piece 8 that extends into the supply chamber 3. This connection piece may be screwed into or otherwise attached into the casing 1.

Within the supply chamber 3, the extending end of the connection piece 8 is provided with a circumferential exterior annular groove 10, which in part is laterally exposed to the chamber 3, and which contains a resilient circlet or seal ring 11. Within the plane of the groove 10, a connecting passage 12 extends between the groove and a feed conduit 13 which preferably penetrates centrally and axially through the connection piece 8. The resilient circlet 11 serves as a valve to control the flow through the passage 12.

With its one end, the feed conduit 13 opens out freely into the supply chamber 3, but is operable to be closed when engaged by the seal disc 7 when the latter is in its rest position. The spring-biased piston thereby serves as supply valve for the conduit 13. The other end of the conduit opens out into the hollow interior of the connection piece 8 which is preferably rotatively symmetrical, and in which a rod-shaped regulating member 21 is fixed against both radial and axial displacement. Through the member 21, the feed conduit 13 of the member continues forward to approximately the plane for another ring-like groove 19*a*, where the feed conduit blindly ends in the regulating member 21. The conduit communicates with the stated ring-like groove 19*a* by means of a preferably diametric through-passage 19. A similar passage 15 and a similar ring-like groove 15*a* is situated approximately midway between the first described passage and ring-like groove and the end of the member 21 nearest to the supply chamber.

Without closing the opening of the feed conduit 13 near the supply chamber, an elastomeric sleeve 16, consisting preferably of rubber, surrounds the regulating member 21 enclosing both of the ring-like grooves. The member 21 has a radial and circumferential shoulder 21*a* between the ring-like grooves, designed to bear with the sleeve 16 in between, against a preferably likewise circumferential shelf 17 in the hollow connection piece 8 to divide the interior of the piece 8 into two interconnected parts forming a vacuum chamber 14 and a discharge chamber 23. The front part of the sleeve extends over the end of the member 21 nearest to the supply chamber and is designed to bear against the front part of the vacuum chamber 14 nearest to the supply chamber. The sleeve is thereby clamped between the member 21 and the connection piece 8 on opposite sides of the groove 15*a* so that the sleeve may expand in the vacuum chamber 14. The rear end of the sleeve 16 terminates beyond the groove 19*a* to resiliently close passage 19.

Enclosed in this way, the vacuum chamber 14 communicates with the discharge chamber 23 around the end of the member 21 facing away from the supply chamber 3 via an overflow channel 18. As revealed in FIGS. 1 and 2, the member 21 can be fixed by means of a cover or the like 22 which may be screwed into the connection piece 8. This cover or the like preferably has a central outlet 24, which is covered from within by the member 21, through which a notch or the like 20 obliquely extends to connect the discharge chamber 23 with the outlet 24.

From the supply chamber 3, a return line 25 extends, whose other end is enclosed by a seat 26, against which a seal disc 27 bears (only in working or similar position) which disc is engaged in the piston 28 of e.g., a solenoid 30 with return spring 29, which can be a tension spring. In the drawing, 31 also designates an electrical connection for the solenoid. The aforesaid seat 26 and the end 28 of the piston with the inserted seal disc 27 is exposed to an intermediate chamber 32, from which the return line 25 continues in the form of return line 33. The disc 27 cooperates with the seat 26 to provide a selectively-operable valve controlling the pressure in the supply chamber 3.

The previously described valve apparatus with control unit shown in FIGS. 1 and 2 functions in the following manner:

As it has been previously stated, according to FIG. 1, the valve and control unit are in position of rest or in a position in which so-called preliminary blowing of oil burner valves can occur, whereby fuel oil may flow via the supply chamber 3 and the parts 2, 25, 32 and out through the line 33 back to a reservoir or a return passage (not shown) of a pump. During this flow, a low overpressure arises in the supply chamber and the stated parts. In order that fuel oil does not reach feed conduit 13, seal disc 7 seals against seat 9 with a pre-adjusted pressure, for example 10 kg/cm$^2$, and the seal ring 11 blocks the connecting passage 12.

Figure 2:
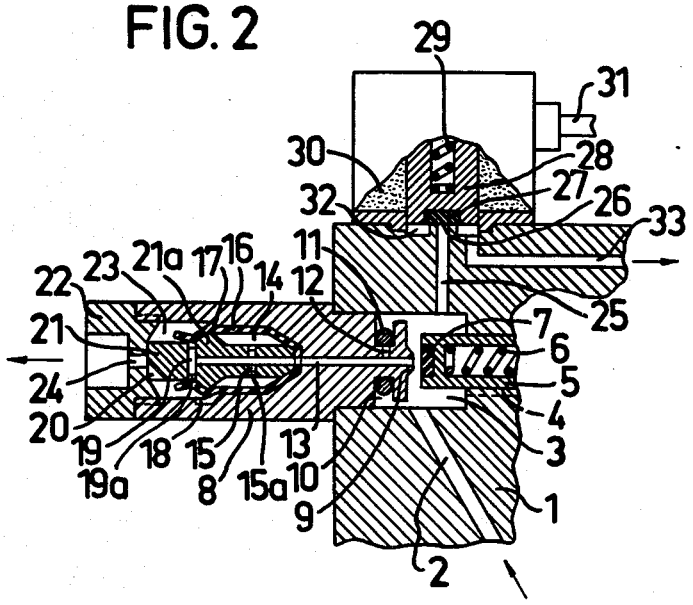
FIG. 2 illustrates the valve and control unit according to FIG. 1 in working position.

When the period of preliminary blowing ends or, in any case, the valve and control unit are to change over to working condition, current is directed to the solenoid 30, whereby the selectively-operable valve closes and the piston 28 assumes a position according to FIG. 2 and seals against the seat 26. The pressure now increases in the inlet 2 and the supply chamber 3 until it reaches the stated pre-adjusted pressure of the pressure-actuated valve, which pressure can be accurately adjusted by means of the spring 6 which can be compressed or expanded in an intrinsically known way. When the aforesaid pre-adjusted pressure on the piston 5 surrounding the seat 9 is exceeded, the pressure piston 5 is moved away from the seat 9 (see FIG. 2). The regulation of pressure occurs via pressure regulating channel 4, which suitably is connected to the same return line as line 33. Fuel oil or liquid in any case can now flow into the feed conduit 13, whereby owing to the high pressure level, the sleeve 16 expands into the vacuum chamber and is pressed against the walls of the vacuum chamber 14, since liquid from the feed channel flows into the passage 15 and the ring-like groove **15*a* in order to then fill a now created space between the sleeve 16 and the member 21 (see FIG. 2). Eventually liquid present in the chamber 14 outside the sleeve can simultaneously flow via the overflow channel 18 into the discharge chamber 23. The liquid then also fills the passage 19 and the ring-like groove 19*a* and freely flows past the sleeve 16 into the discharge chamber 23 and from there via the notch 20 into the outlet 24** and further to its destination, e.g., a burner nozzle under the exact pressure desired.

When the liquid flow is to be interrupted, current to the solenoid 30 is broken, opening the selectively-operable valve, which then again allows the liquid to flow from the inlet 2 to the return line 33 and further with the result that the pressure in the supply chamber 3 decreases to under the pre-adjusted value, so that the pressure-operated valve closes since the pressure piston 5 quickly moves to its blocking position, i.e., to bear against the seat 9. The pressure then also decreases rapidly in among other parts including the feed conduit 13, whereby the section of the sleeve 16 present in the space 23 returns to bear against the member 21 and functions as a one-way valve to block the ring-like groove **19*a* and the passage 19 from without. After that, the section of the sleeve surrounding the groove 15*a* expanded in the vacuum chamber 14 is contracted, whereby this liquid mass is pressed out through the ring-like groove 15*a* and the passage 15 into the feed conduit 13 and from there via the connecting passage 12 and during lifting away of the seal ring 11 into the supply chamber 3. During the stated contraction of the sleeve, a limited amount of liquid is simultaneously sucked back from the outlet via the notch 20 and the discharge chamber 23 as well as the overflow channel 18 into the vacuum chamber 14 surrounding the sleeve 16. In this way, so-called post-drip at a nozzle of any kind is effectively prevented. The liquid amount is pressed back past the valve formed by the ring 11, then flows via the supply chamber 3, the return line 25 and the intermediate chamber 32 to the return line 33. It can also be mentioned that the seal ring 11 can bear against the connecting passage 12** with very low pressure. Through this means, a reliable one-way valve function is always guaranteed.

Figure 3:
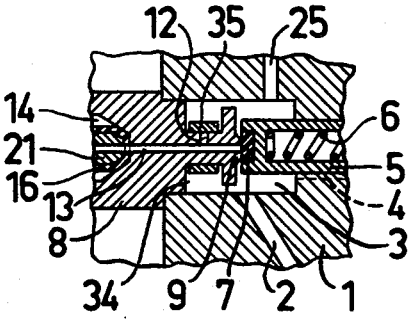
FIGS. 3–5 are partial views according to FIG. 1, each with a modified pressure-relief auxiliary valve for the anti-drip valve unit.

Some variations of the one-way valve for the connecting passage 12 are shown in the following figures. Consequently, in FIG. 3, instead of the narrower groove 10, a wider groove 34 is shown, against the bottom of which bears an elastomeric circlet or ring 35 with a flat and rectangular cross-section instead of the previously-described O-ring 11 that is circular in cross-section.

Figure 4:
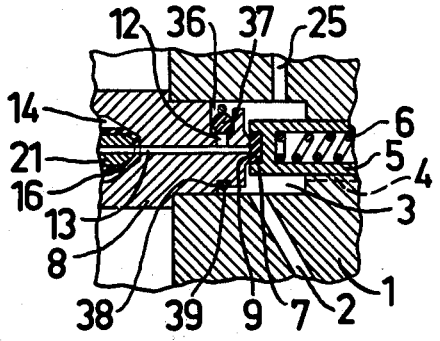

In FIG. 4, the connecting passage 12 leads outward into a wider shelf-like bore 36, in which a valve element in the form of a ball 37 is engaged, which is preferably held by low pressure directed against the connecting passage 12 by means of an elastomeric circlet or ring 39, preferably of elastic rubber-like material, engaged in a smaller outer circumferential groove 38.

Figure 5:
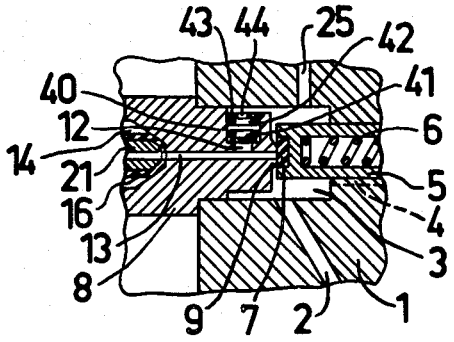

In FIG. 5, any circumferential groove or the like has been eliminated and there is instead only a shelf-like bore 40 in communication with the connecting passage 12. A valve element in the form of a diaphragm 41 bears against the bottom of the bore 40 under the influence of a spring 42, whose other end may rest against a washer 43 provided with a hole 44.

The forms of the embodiment described above and illustrated in the drawing figures are only to be considered as non-limiting examples, which can be modified and supplemented at will within the scope of the invention as defined in the following claims.

I claim:

1. Valve apparatus for fluids comprising:

a housing having a supply chamber, a discharge chamber, and a vacuum chamber connected to said discharge chamber through a passage;

a conduit leading from said supply chamber to said discharge chamber;

pressure-actuated supply valve means at the supply end of said conduit operable in response to the fluid pressure in said supply chamber to open and close above and below a predetermined pressure level respectively;

an expandable member in said vacuum chamber responsive to the fluid pressure in said conduit to reduce the volume of said chamber when said conduit is under fluid pressure and to expand the volume of said chamber when said fluid pressure is relieved;

one-way discharge valve means at the discharge end of said conduit to permit fluid flow from said conduit into said discharge chamber when said conduit is under fluid pressure; and one-way bypass valve means bypassing said supply valve means to permit reverse flow of fluid from said conduit into said supply chamber when said pressure-actuated valve is closed, to thereby relieve pressure in said conduit, affording expansion of said vacuum chamber.

2. Valve apparatus according to claim 1 including selectively-operable valve means operable independently of said pressure-responsive valve means to control the presence of fluid pressure in said supply chamber.

3. Valve apparatus according to claim 2 wherein said selectively-operable valve means includes a return line and a solenoid-actuated valve selectively disconnecting said supply chamber from the return line to maintain the presence of fluid pressure in said supply chamber.

4. Valve apparatus according to claim 1 including a connection section in said housing having one end extending into said supply chamber, said conduit comprising a channel extending through said one end of the connection section, said one-way valve means including a radial passage in said one end from said conduit channel to said supply chamber and a valve element having means biasing the element to a position closing said radial passage.

5. Valve apparatus according to claim 4 wherein said bias means comprises a resilient circlet surrounding said end portion, and said end portion has a circumferential annular groove for retaining said circlet in proper position relative to said passage.

6. Valve apparatus according to claim 5 wherein said resilient circlet is operable to engage said radial passage and functions as a valve element.

7. Valve apparatus according to claim 6 wherein said circlet is an O-ring of circular cross section.

8. Valve apparatus according to claim 6 wherein said circlet is a ring having a flat rectangular cross section.

9. Valve apparatus according to claim 5 wherein said valve element comprises a ball disposed between said circlet and said passage.

10. Valve apparatus according to claim 4 wherein said valve element comprises a diaphragm engaging said passage and said bias means comprises spring means urging said diaphragm into engagement.

* * * * *